US012729537B2

(12) United States Patent
Strabala

(10) Patent No.: US 12,729,537 B2
(45) Date of Patent: Sep. 8, 2026

(54) CONCRETE REINFORCEMENT CAGE LOCK WITH MINIMAL INTRUSION INTO THE CONCRETE COVER

(71) Applicant: HAWKEYEPEDERSHAAB CONCRETE TECHNOLOGIES, INC., Clayton, MO (US)

(72) Inventor: Dave Strabala, Mediapolis, IA (US)

(73) Assignee: HAWKEYEPEDERSHAAB CONCRETE TECHNOLOGIES, INC, St. Louis, MO (US)

( * ) Notice: Subject to any disclaimer, the term of this patent is extended or adjusted under 35 U.S.C. 154(b) by 153 days.

(21) Appl. No.: 18/742,899

(22) Filed: Jun. 13, 2024

(65) Prior Publication Data

US 2025/0027317 A1 Jan. 23, 2025

Related U.S. Application Data

(60) Provisional application No. 63/595,454, filed on Nov. 2, 2023, provisional application No. 63/528,014, filed on Jul. 20, 2023.

(51) Int. Cl.
*E04C 5/06* (2006.01)
*E04C 5/16* (2006.01)

(52) U.S. Cl.
CPC ..... *E04C 5/064* (2013.01); *E04C 5/168* (2013.01)

(58) Field of Classification Search
CPC . E04C 5/168; E04C 5/18; E04C 5/167; E04C 5/163; E04C 5/064
See application file for complete search history.

(56) References Cited

U.S. PATENT DOCUMENTS

| | | | | | |
|---|---|---|---|---|---|
| 4,467,995 | A * | 8/1984 | Tolliver | E04C 5/18 | 249/83 |
| 4,989,388 | A * | 2/1991 | Schmidgall | E04C 5/168 | 52/649.8 |
| 4,999,965 | A * | 3/1991 | Schmidgall | E04C 5/064 | 52/719 |
| 5,181,363 | A * | 1/1993 | Leach | E04C 5/168 | 52/685 |
| 5,832,690 | A * | 11/1998 | Kaines | E04C 5/163 | 52/712 |
| 5,896,722 | A * | 4/1999 | Swenson | E04C 5/163 | 52/712 |
| 10,975,573 | B1 * | 4/2021 | Strabala | E04C 5/168 | |
| 11,098,488 | B2 * | 8/2021 | Toyoda | E04C 5/167 | |

* cited by examiner

*Primary Examiner* — Brian E Glessner
*Assistant Examiner* — Daniel J Kenny
(74) *Attorney, Agent, or Firm* — SHUTTLEWORTH & INGERSOLL, PLC; Jason R. Sytsma

(57) ABSTRACT

A first lock formed on the first end portion configured for attachment by torsion to a first reinforcement wire mesh cage of the two reinforcement wire mesh cages with a first spacer cover extending from the first lock away from the intermediate portion. A second lock formed on the second end portion comprising the same to hold two reinforcement wire mesh cages a fixed distance apart from each other with the first spacer cover and the second spacer cover being less than a distance between respective reinforcement cages and spaced apart inner surface of the form.

20 Claims, 5 Drawing Sheets

CONCRETE REINFORCEMENT CAGE LOCK WITH MINIMAL INTRUSION INTO THE CONCRETE COVER

PRIORITY

This Non-Provisional U.S. Patent Application claims priority to U.S. Provisional Patent Application No. 63/595,454 filed on Nov. 2, 2023 titled, CONCRETE REINFORCEMENT CAGE LOCK WITH MINIMAL INTRUSION INTO THE CONCRETE COVER, and U.S. Provisional Patent Application No. 63/528,014 filed Jul. 20, 2023 titled, CONCRETE REINFORCEMENT CAGE LOCK WITH REDUCED COVER, the entire contents of each of which are hereby incorporated by reference herein.

TECHNICAL FIELD

This disclosure relates to the production of concrete products, and more specifically, this disclosure relates to reinforcement cage lock with a reduced spacer cover intruding into the concrete cover.

BACKGROUND INFORMATION

In producing large concrete products such as box culvert, round pipes, or manholes, two reinforcement wire mesh cages are often required to provide the necessary strength. The cages must be spaced from each other and also spaced from the surfaces of the form used to produce the particular concrete product.

At the present time, the most common spacer used for double cage reinforcement wire mesh for rectangular concrete products, such as box culvert, is a steel spacer that has a long straight piece that determines the spacing between the two reinforcement cages (or the bearing to bearing distance) with an eye at each end of the straight section, each of which positions each of the cages from the surfaces of the product form. The material of the spacer that protrudes into the concrete cover is referred to as the "cover" of the spacer of the "spacer cover." In the prior art, the cover of the spacer is formed by the eye, which positions the cage from the surface of the concrete product.

FIG. 1 shows the spacer disclosed in U.S. Pat. No. 4,999,965. Two reinforcement wire mesh cages that are required for the larger round pipes and rectangular culverts and manhole concrete products is shown. The inner cage 10 and the outer cage 12 each have a plurality of parallel spaced apart vertical wires 14 joined to a plurality of horizontally spaced apart parallel circumferential wires 16. As is well known to those skilled in the art, these cages 10 and 12 are positioned inside of the space defined by the forms used in producing the particular rectangular or cylindrical concrete product that will ultimately form a box culvert, a pipe, culvert, or manhole.

The cages 10 and 12 must be properly positioned inside the forms and maintain their position during the manufacturing process. The space between the forms is filled with concrete and vibration and other forces are applied to the form to assure that all of the voids are filled with concrete. This means that there will be twisting and other forces exerted upon the cages 10 and 12. The cages 10 and 12 must maintain proper spacing from each other and from the surfaces of the form throughout the manufacturing process.

Spacer 18 is designed to attach to cages 10 and 12 and properly space cages 10 and 12 from the inner sides of the form. Spacer 18 has a central straight portion with a U-shaped spacing bend or bearing 19 formed at opposite ends of the straight portion to hook onto the wires 14 or 16 of cages 10 and 12. These bearings 19 positively position both of the cages at the predetermined distance. In order to space the cages 10 and 12 from both the inner and outer surfaces of the concrete forms, an eye 17 is formed at the outer ends of the spacer. Each eye 17 is formed as an open loop, the outer leg of which is directed away from the plane of the central straight portion. Each eye 17 provides the material at each end of spacer 18 to set the distance between the outermost portion of the cage and the surface of the product while the elongated straight section sets the distance between the cages from bearing 19 to bearing 19. The concrete cover "□" in the concrete product 20 is the distance between the outermost steel reinforcement of cage 10, 12 and outside of the concrete product. It can be seen that each eye 17 of spacer 18 positions the respective inner cage 10 and outer cage 12 from the respective inner surface and the outer surface of the concrete product.

Certain regulatory agencies are concerned that the steel eye or the material of the spacer when exposed to the elements could rust. This might happen when the eye 17 is exposed at the surface of the concrete product. As the steel rusts, it could degrade the metal and can become a conduit for water to reach the metal reinforcement inside of concrete product 20. If the reinforcement deteriorates due to rusting, the product can be compromised and failure could occur.

Accordingly, there is a need for an improved metal spacer with spacer cover that minimally protrudes into the concrete cover and is configured to receive a plastic, concrete, or any other non-metallic or non-rusting material to provide the outer spacing between the cage and the form attached thereto. In other words, the spacer cover is minimalized with a secondary attachment setting the respective distances between the cages and the walls of the form.

SUMMARY

Disclosed herein is a spacer for positioning an inner reinforcement cage with respect to an outer reinforcement cage that are used in forms for producing concrete products. The spacer can comprise a continuous length of material comprising a diameter, a first end portion, a second end portion, and an intermediate portion therebetween. An inner cage, first wire lock can be formed by a first bend in the first end portion of the continuous length of material, wherein the first bend in the first end portion can be defined by a first radius having a first center and a first circumference. An inner cage, second wire lock can be formed by a second bend in the first end portion of the continuous length of material, wherein the inner cage, first wire lock and the inner cage, second wire lock are attachable by torsion on to the inner cage, wherein the second bend in the first end portion is defined by a second radius having a second center and second circumference.

In an embodiment, the first bend and the second bend in the first end portion can have a common axis extending through the respective first center and the second center transverse to an orientation of the intermediate portion to allow the inner cage, first wire lock and the inner cage, second wire lock to lock on opposite sides of a wire on the inner cage.

A first spacer cover connects the inner cage, first wire lock and the inner cage, second wire lock of the first end portion. The first spacer cover extends outward from the first circumference of the first radius of the first bend a distance at least the diameter of the continuous length of material and less than or equal to a pre-determined maximal protrusion into a concrete cover defined by a distance between the inner cage and the inner surface of one side of the form. The second end portion can be a mirror image of the first end portion.

The spacer cover can extend into the concrete product substantially equal to a diameter of the continuous length of material. The spacer cover is oriented on a plane perpendicular to the intermediate portion of the continuous length of material. In other embodiments, the spacer cover comprise a hump formed in the first end portion by a second bend toward a direction perpendicular to the intermediate portion of the continuous length of material, so that the hump is oriented on the plane perpendicular to the intermediate portion of the continuous length of material. The hump can be formed from a bend around an axis parallel to the intermediate portion of the spacer. The spacer cover can be configured according to safety standards and less than the concrete cover of the concrete product.

In an embodiment, the intermediate portion of the continuous length of material is substantially straight. The distance between the inner cage and the outer cage can be defined by the distance between the inner cage, first wire lock on the first end portion and the outer cage, first wire lock on the second end portion of the continuous length of material. Alternatively, the first bend in the first end portion of the continuous length of material can comprise of a center which is positioned above the intermediate portion of the continuous length of material.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
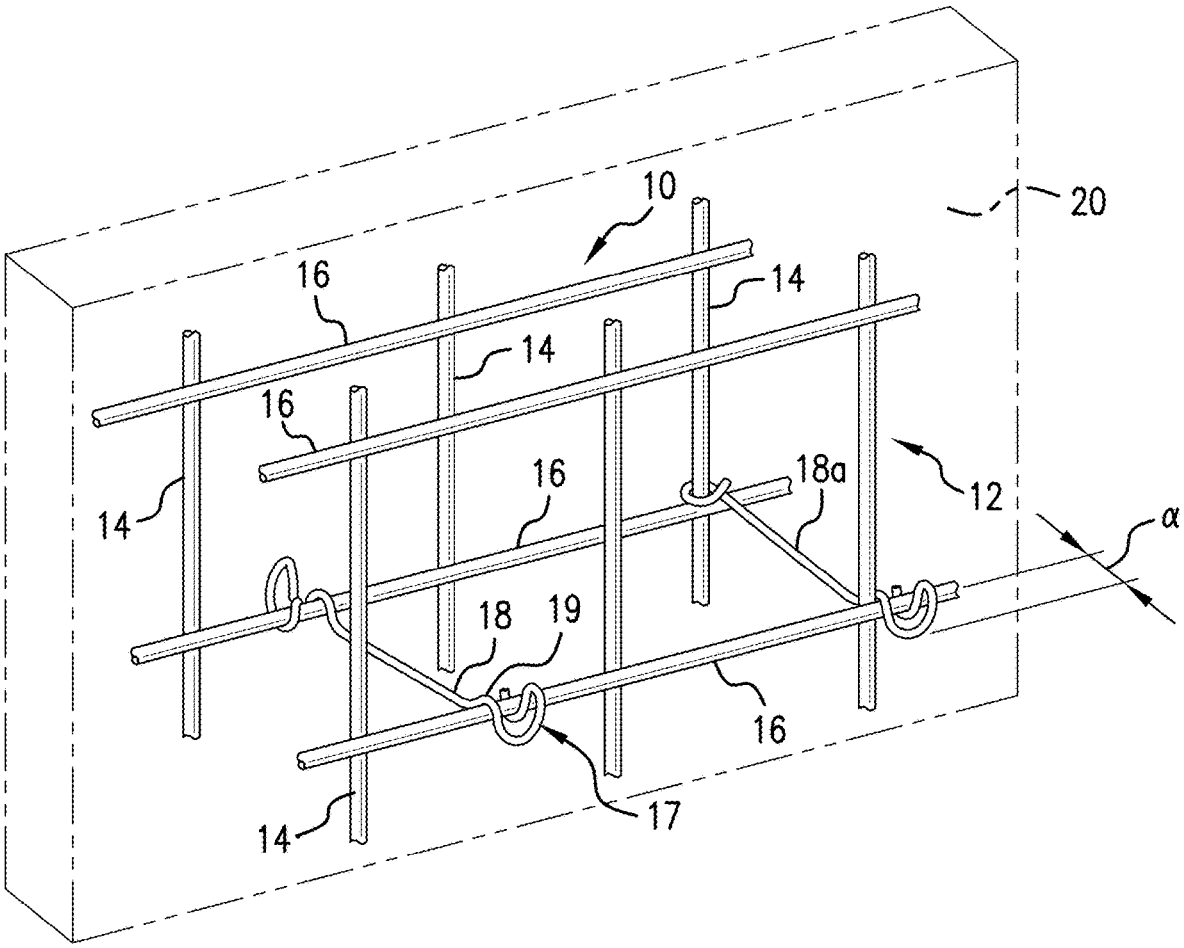
FIG. 1 Prior Art
FIG. 1 is a perspective view of a spacer of the prior art showing a portion of two wire mesh cages with the spacer locked in place.
Figure 2:
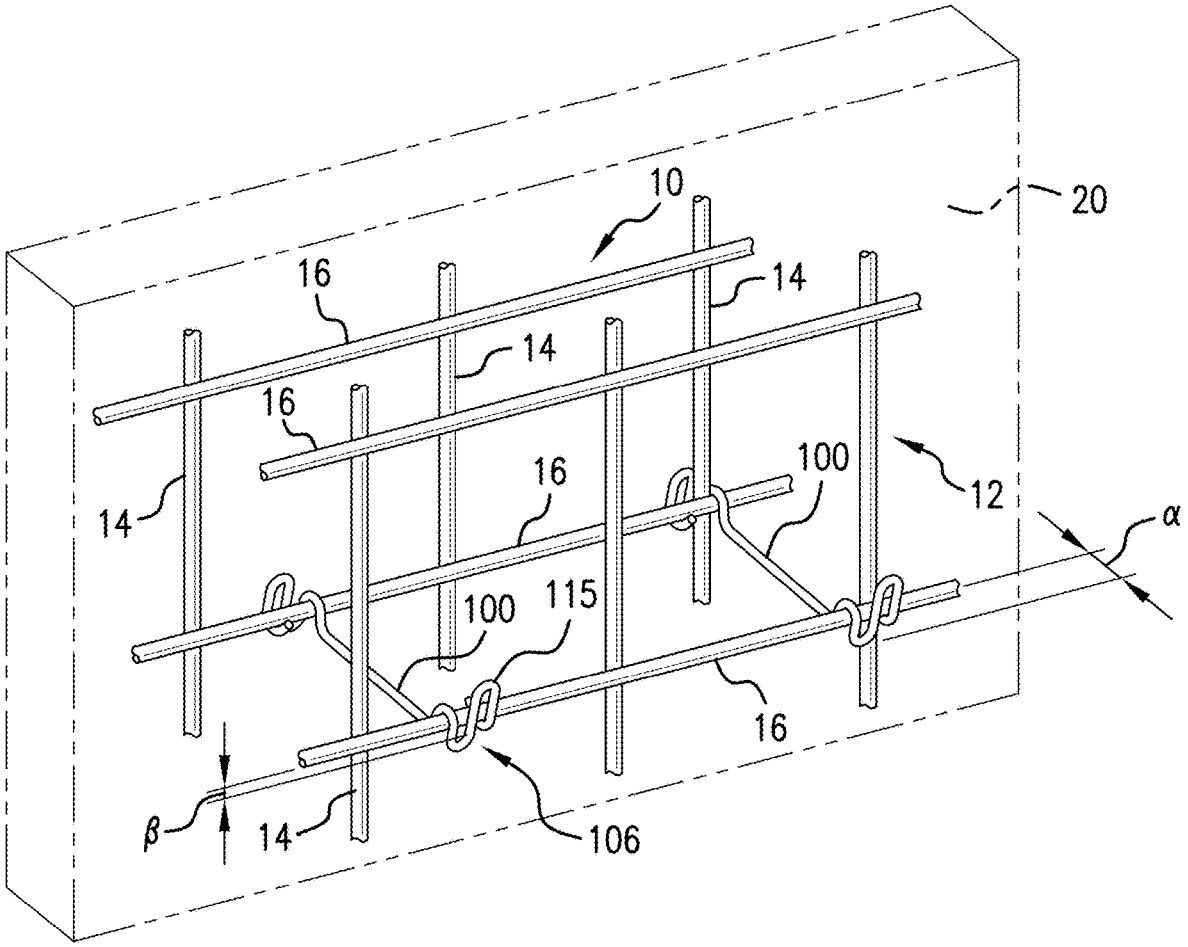
FIG. 2 is a perspective view showing a portion of two wire mesh cages with the spacer, according to this disclosure, locked in place.
Figure 3:
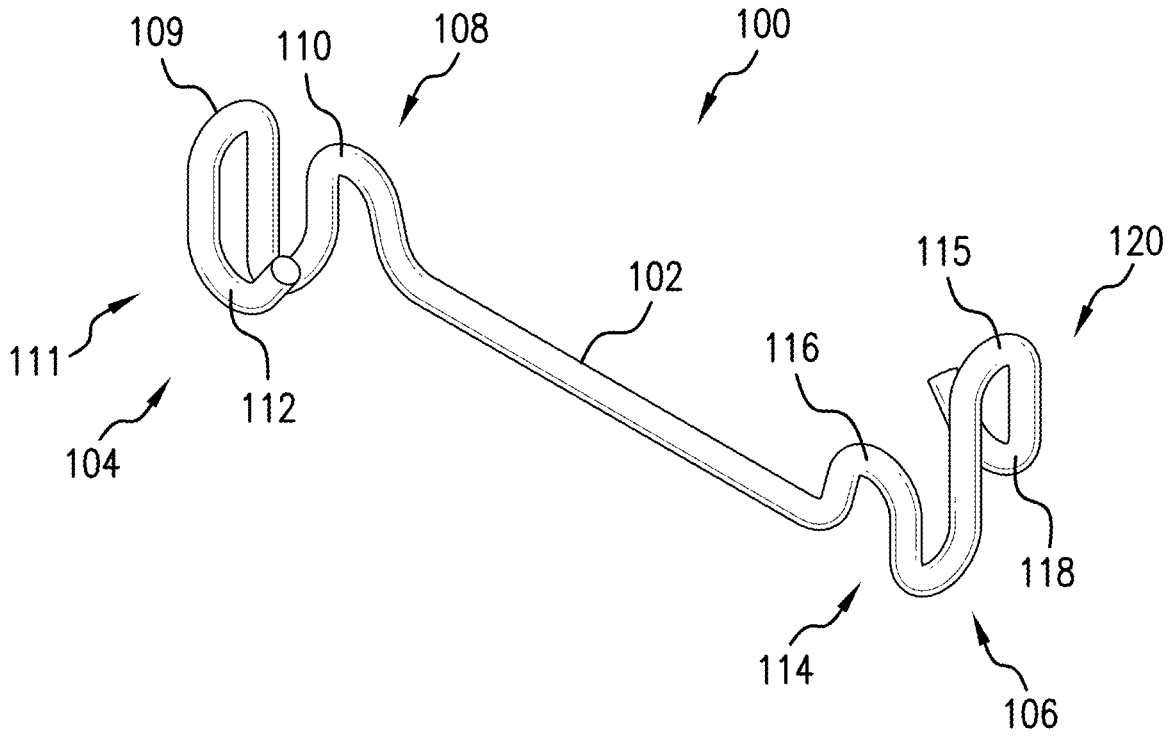
FIG. 3 is a perspective view of the spacer of FIG. 2.
Figure 4:
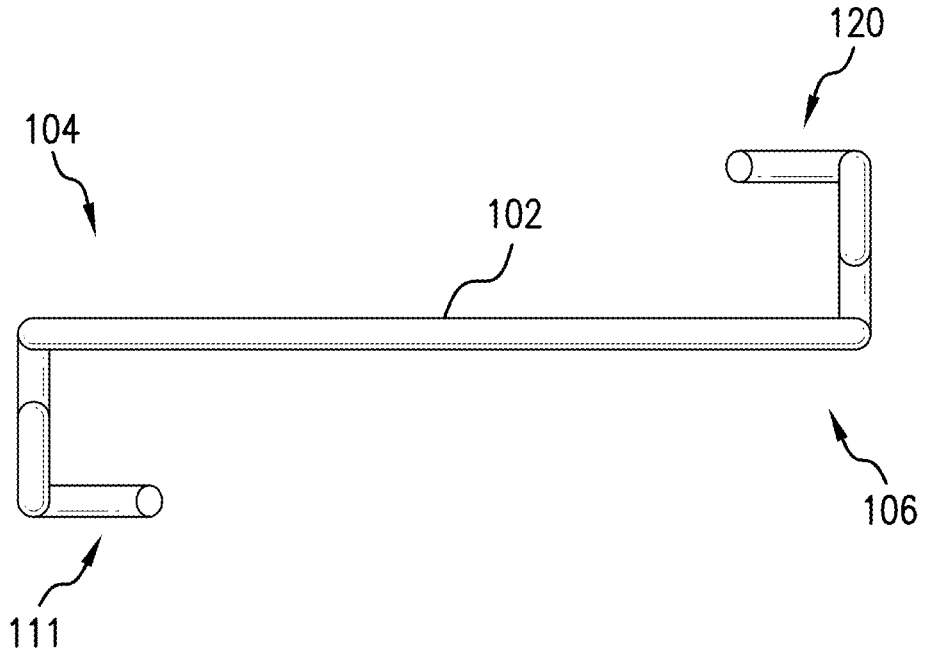
FIG. 4 is a top view of the spacer of FIG. 2

Referring to FIG. 2, there is illustrated the reinforcement wire mesh cage of FIG. 1, which is required for the larger round pipes and rectangular culverts and manhole concrete products. As previously stated, inner cage 10 and outer cage 12 each have a plurality of parallel spaced apart vertical wires 14 joined to a plurality of horizontally spaced apart parallel circumferential wires 16. As is well known to those skilled in the art, these cages 10 and 12 are positioned inside of the space defined by the forms used in producing a particular rectangular or cylindrical concrete product 20 that will ultimately used as a box culvert, a pipe, culvert, or manhole. Cages 10 and 12 must be properly spaced from each other. It is also important that the cages maintain the proper position as vibration and other forces are applied during processing to assure that all of the voids in the form are filled with concrete. The spacers constructed according to the principles of the invention are capable of resisting all of the forces, twisting and otherwise, and once in place, the spacers of the invention will not fall off even though not welded or otherwise tied to the cages.

Spacer 100 is more clearly illustrated in FIGS. 3-6. Spacer 100 comprises of an intermediate portion 102 between a first end portion 104 and a second end portion 106 all of which is formed from one single continuous length of material (e.g. a round wire) with the various bends described below giving spacer 100 flexibility for torsion attachment to the respective cages 10 and 12. First end portion 104 and second end portion 106 contain the locking features necessary to position both of the cages 10, 12 at the predetermined bearing to bearing distance from each other. The bearing is defined as the center of the bend of the lock (first wire lock 108 and second wire lock 120, referenced below) with the bearing to bearing distance being the distance between the center of each bend of the respective locks 108, 120 extending across intermediate portion 102. Unique to spacer 100, however, is the reduced or minimal "spacer cover" that only minimally intrudes into the concrete cover.

Figure 5:
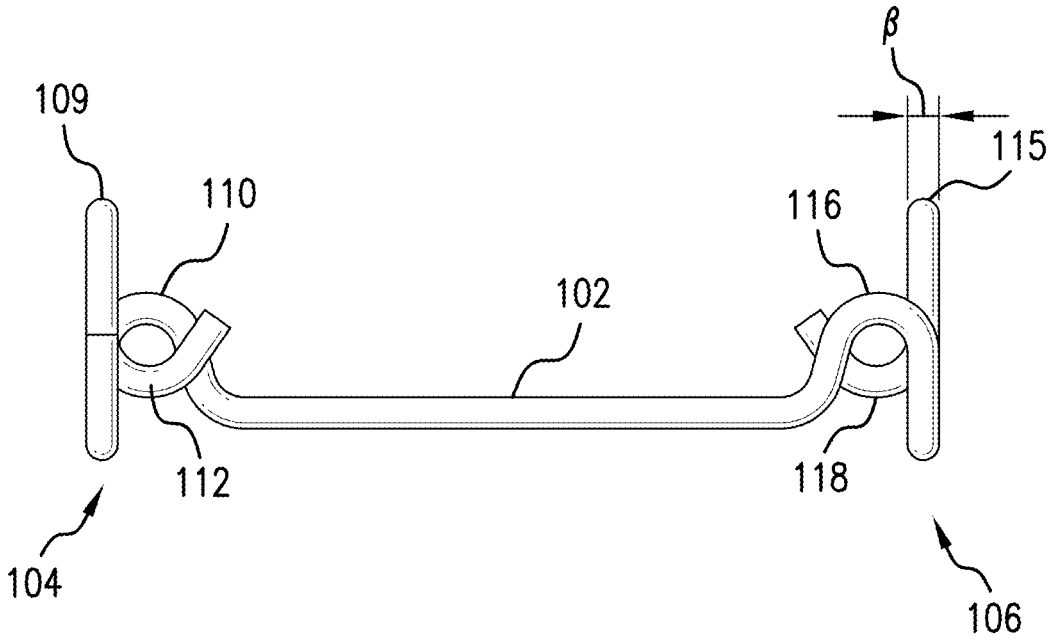
FIG. 5 is a front view of the spacer of FIG. 2.
Figure 6:
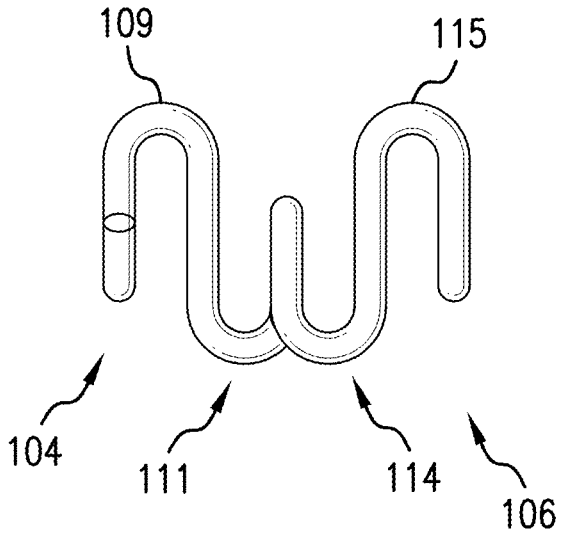
FIG. 6 is an end view of the spacer of FIG. 2.

Referring to FIG. 5, shown is a front view of spacer 100. Imagine spacer 100 being locked onto a wire of reinforcement cage 10 with the wire being positioned in the space between first bend 110 and backward bend 112 in first end portion 104, as shown in FIG. 2. Spacer cover "β" as described above, is the portion of material of spacer 100 extending from the outermost portion of the wire of the respective reinforcement cage 10, 12. Due to certain specifications limiting the use of metallic material in the concrete cover □, spacer 100 has a spacer cover β extending into the concrete cover □ in an amount about or substantially equal to the diameter of the continuous length of material of which spacer 100 is made. In other words, spacer cover β is only the amount of material necessary for the respective first end portion 104 and second end portion 106 to lock on to the respective reinforcement cages 10, 12. This means substantially equal to is at least the diameter of the continuous length of material (e.g., the round wire) and up to an amount necessary to make the bends. This is accomplished by the novel orientation of the various bends in the continuous length of material of which spacer 100 is formed.

First end portion 104 of spacer 100 locks via torsion on to inner cage 10 and second end portion 106 of spacer 100 locks to outer cage 12 by torsion. To accomplish this, each of first end portion 104 and second end portion 106 has a pair of wire locks that lock against the wire of the respective cages. With respect to first end portion 104, inner cage, first wire lock 108 and inner cage, second wire lock 111 lock on to the top and bottom of a wire, respectively. With respect to second end portion 106, outer cage, first wire lock 114 and outer cage, second wire lock 120 lock onto the top and bottom of a wire, respectively.

More specifically, with respect to a first embodiment, as can be seen, first end portion 104 and second end portion 106 are mirror images of each other. First end portion 104 of the continuous length of material comprises of an inner cage, first wire lock 108 formed by a first bend 110 in first end portion 104 of the continuous length of material. First bend 110 is formed by bending the continuous length of material around a center corresponding to the diameter of the wire of inner cage 10. In this illustrated embodiment, first bend 110 is linearly aligned like a wave in intermediate portion 102 with a center of first bend 110 having an axis oriented perpendicular to and above the length of intermediate portion 102. Comparing this embodiment, however, with the spacer 100 of FIG. 7, it can be seen that intermediate portion 102 can extend linearly from inner cage, first wire lock 108 to outer cage, first wire lock 114. The important feature being common to each embodiment are the respective wire locks.

First end portion 104 is bent perpendicular to intermediate portion 102 then bent upward and around another center aligned on an axis parallel to intermediate portion 102 to form a hump 109 followed by a backward bend 112 upward with backward bend 112 being formed around a center with an axis coaxially aligned with first bend 110 forming an inner cage, second wire lock 111 of first end portion 104. This configuration of bends presents inner cage, first wire lock 108 with a downward opening and inner cage, second wire lock 111 with an upward opening with the centers of each coaxially aligned such that the inner cage, first wire lock 108 engages one of the wires of inner cage 10 in a first direction and inner cage, second wire lock 111 engages the same wire of inner cage 10 in a second direction. In this arrangement, it can be seen upward and downward are relative terms of direction as are first direction and second direction with the relative terms of direction being opposite of each other.

The material that extends between first wire lock 108 and second wire lock 111 can be any shape, but preferably it does not extend outward any more than necessary to keep the material of the spacer that extends into the concrete cover □ as minimal as possible. In the illustrated embodiment, for example, hump 109 of first end portion 104 separates inner cage, first wire lock 108 from inner cage, second wire lock 111. Hump 109 is aligned with an outer surface along a plane perpendicular to intermediate portion 102. The amount of material extending into the concrete cover □ is substantially the same as the diameter of the wire forming spacer 100. In other words, the amount of material of spacer cover β extending into the concrete cover □ is only the amount of material necessary for the respective first end portion 104 and second end portion 106 to lock on to the respective reinforcement cages 10, 12.

Second end portion 106 of the continuous length of material is a mirror image of first end portion 104 and comprises of an outer cage, first wire lock 114 formed by a first bend 116 in second end portion 106 of the continuous length of material. First bend 116 is formed by bending the continuous length of material around a center corresponding to the diameter of the wire in outer cage 12 such that first bend 116 is linearly aligned like a wave in intermediate portion 102 with a center of first bend 116 having an axis oriented perpendicular to and above the length of intermediate portion 102.

Second end portion 106 is further bent perpendicular to intermediate portion 102 then bent upward and around another center aligned on an axis parallel to intermediate portion 102 to form a hump 115 followed by a backward bend 118 upward with backward bend 118 being formed around a center with an axis coaxially aligned with first bend 116 forming an outer cage, second wire lock 120 of second end portion 106. This configuration of bends presents outer cage, first wire lock 114 with a downward opening and outer cage, second wire lock 120 with an upward opening with the centers of each coaxially aligned such that outer cage, first wire lock 114 engages one of the wires of outer cage 12 in a first direction and outer cage, second wire lock 120 engages the same wire on outer cage 12 in a second direction.

Hump 115 of second end portion 106 separates outer cage, first wire lock 114 from outer cage, second wire lock 120. Hump 115 is aligned with an outer surface along a plane perpendicular to intermediate portion 102. The amount of material extending into the concrete cover □ is substantially the same as the diameter of the wire forming spacer 100. The amount of material extending into the concrete cover □ is only the amount of material necessary for the respective first end portion 104 and second end portion 106 to lock on to the respective reinforcement cages 10, 12.

Figure 7:
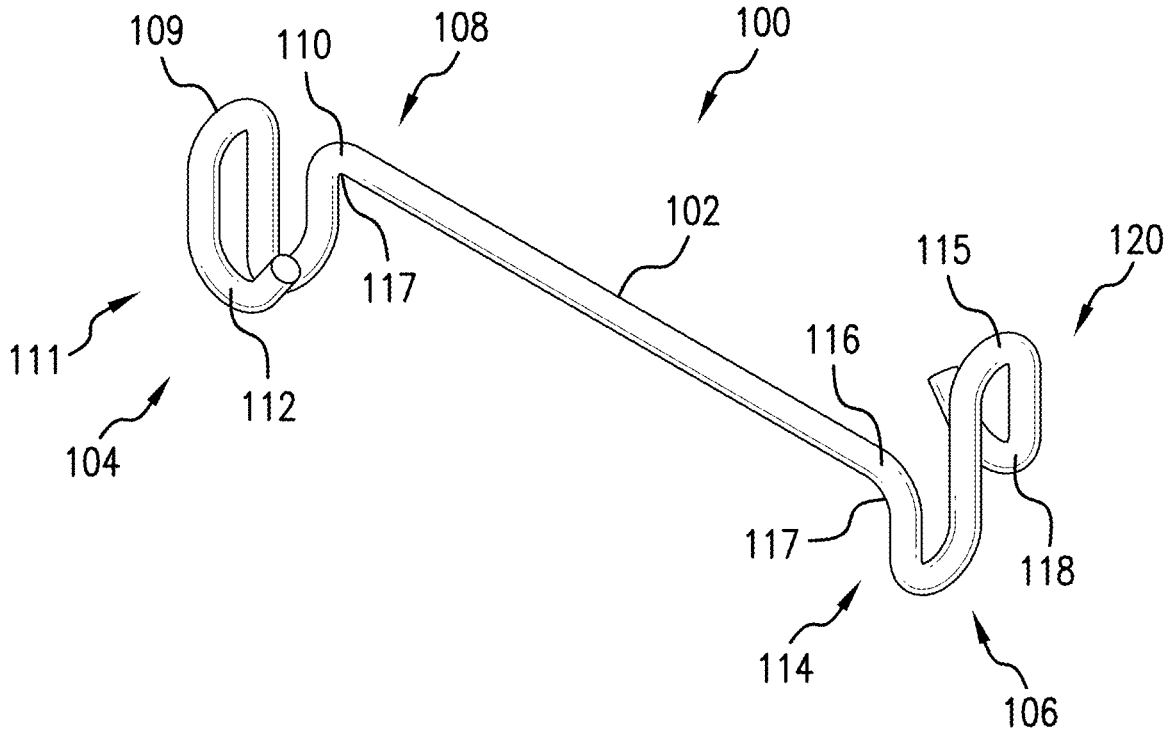
FIG. 7 is an alternative embodiment of a spacer according to this disclosure.

Referring to FIG. 7, shown is spacer 100 but with intermediate portion 102 extending linearly from inner cage, first wire lock 108 to outer cage, first wire lock 114. Spacer 100 is otherwise the same configuration. Inner cage, first wire lock 108 is formed by first bend 110 in first end portion 104 of the continuous length of material. Outer cage, first wire lock 114 is formed by first bend 116 in second end portion 106 of the continuous length of material. Bearing 117 is on the inner circumference of the first bend 110 at each end forming a bearing 117 to bearing 117 between respective reinforcement cages 10, 12.

The functions of spacer 100 is best understood by an explanation of how the spacer is installed between inner cage 10 and outer cage 12. The installer is normally outside of the outer cage 12, and to install spacer 100 on inner cage 10 and outer cage 12, the installer grasps one end of spacer 100 and inserts it inwardly between two of the circumferential wires 16 on inner cage 10. It makes no difference which end of spacer 100 is grasped, since spacer 100 is symmetrical and each end is a mirror image of each other. Once spacer 100 is inserted between two of the circumferential wires 16, inner cage, first wire lock 108 of first end portion 104 is positioned on a wire 16 of inner cage 10 and then rotated counter-clockwise and twisted to snap inner cage, second wire lock 111 of first end portion 104 on wire 16. Next, outer cage, first wire lock 114 of second end portion 106 is positioned near wire 16 of outer cage 12 and rotated clockwise and twisted to snap outer cage, second wire lock 120 of second end portion 106 underneath wire 16 and then released for outer cage, first wire lock 114 of second end portion to snap into position.

When properly installed as described above, the configuration of the spacer 100 tightly locks the inner cage 10 and outer cage 12 into an integral unit of reinforcement. The positive torsional locking feature provided by the configuration at each end of the spacer 100 of that provides a first wire lock and a second wire lock at each end of spacer 100 means spacers 100 will not fall off during the manufacturing process and will resist forces in any direction without becoming loose. Also, there is no concern as to which way the spacer 100 is to be installed, since it is each end is a mirror image of each other. Most importantly, spacer 100 spacer cover of spacer cover β has a minimal amount of material extending into the concrete cover □ to maximize the distance between the outer surface of the concrete product and spacer 100, so that spacer 100 does not get exposed to the elements and erode or oxidize.

Those skilled in the art will recognize that the spacer cover β of spacer 100 extending into the concrete cover □ is reduced as compared to spacers of the prior art (e.g., FIG. 1) to provide minimal intrusion of the spacer cover β into the concrete cover □. The spacer cover β has been described herein as the amount of material extending into the concrete cover □ being substantially the same as the diameter of the wire forming spacer 100, or only the amount of material necessary for the respective first end portion 104 and second end portion 106 to lock on to the respective reinforcement cages 10, 12. This could lead to hump 109 and hump 115 being aligned with an outer surface along a plane perpendicular to intermediate portion 102. Those skilled in the art will recognize that the respective hump 109 and hump 115 or any other configuration of the wire could be bent outward towards the respective surfaces of the concrete product 20 at an angle greater than perpendicular but less than the specified amount of metal-free material in the concrete cover □. In other words, reduced cover provided by spacer cover β means the spacer 100 having only the amount of metal extending into the concrete cover □ as permitted by specification for the concrete product 20, which is less than the prior art eye of FIG. 1 that extends to or near the outer surface of the concrete product 20.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A spacer for positioning an inner cage with respect to an outer cage for reinforcing a concrete product, the inner cage and the outer cage each have a plurality of parallel spaced-apart horizontal wires joined to a plurality of parallel spaced-apart vertical wires and the inner cage and the outer cage are positioned in a form that has spaced-apart inner surfaces, said spacer comprising:

a continuous length of material comprising a diameter, a first end portion, a second end portion, and an intermediate portion therebetween;

an inner cage, first wire lock formed by a first bend in the first end portion of the continuous length of material wherein the first bend in the first end portion is defined by a first radius having a first center and a first circumference;

an inner cage, second wire lock formed by a second bend in the first end portion of the continuous length of material, wherein the inner cage, first wire lock and the inner cage, second wire lock are attachable by torsion on to the inner cage, wherein the second bend in the first end portion is defined by a second radius having a second center and second circumference;

a first spacer cover connecting the inner cage, first wire lock and the inner cage, second wire lock of the first end portion, with the first spacer cover extending outward from the first circumference of the first radius of the first bend a distance at least the diameter of the continuous length of material and less than or equal to a pre-determined maximal protrusion into a concrete cover defined by a distance between the inner cage and the inner surface of one side of the form, wherein the first spacer cover is oriented on a plane perpendicular to the intermediate portion of the continuous length of material;

an outer cage, first wire lock formed by a first bend in the second end portion of the continuous length of material wherein the first bend in the second end portion is defined by a first radius having a first center and a first circumference; and an outer cage, second wire lock formed by a second bend in the second end portion of the continuous length of material, wherein the outer cage, first wire lock and the outer cage, second wire lock are attachable by torsion on to the outer cage, wherein the second bend in the second end portion is defined by a second radius having a second and second circumference;

a second spacer cover connecting the outer cage, first wire lock and the outer cage, second wire lock of the second end portion, with the second spacer cover extending outward from the first circumference of the first radius of the second bend a distance at least the diameter of the continuous length of material and less than or equal to the pre-determined maximal protrusion into the concrete cover defined by a distance between the outer cage and the inner surface of the other side of the form.

2. The spacer of claim 1, wherein the first bend and the second bend in the first end portion have a common axis extending through the respective first center and the second center transverse to an orientation of the intermediate portion to allow the inner cage, first wire lock and the inner cage, second wire lock to lock on opposite sides of a wire on the inner cage.

3. The spacer of claim 1, wherein the first spacer cover extends into the concrete product a distance that is substantially equal to the diameter of the continuous length of material.

4. The spacer of claim 3, wherein the second spacer cover is oriented on a plane perpendicular to the intermediate portion of the continuous length of material.

5. The spacer of claim 1, wherein the spacer cover comprises a hump formed in the first end portion by a second bend toward a direction perpendicular to the intermediate portion of the continuous length of material so that the hump is oriented on the plane perpendicular to the intermediate portion of the continuous length of material.

6. The spacer of claim 5, wherein the hump is formed from a bend around an axis parallel to the intermediate portion of the spacer.

7. The spacer of claim 1, wherein a dimension of the spacer cover is less than a dimension of the concrete cover of the concrete product.

8. The spacer of claim 1, wherein the intermediate portion of the continuous length of material is substantially straight, wherein a distance between the inner cage and the outer cage is defined by the distance between the inner cage, first wire lock on the first end portion and the outer cage, first wire lock on the second end portion of the continuous length of material.

9. The spacer of claim 8, wherein the first bend in the first end portion of the continuous length of material comprises a center which is positioned above the intermediate portion of the continuous length of material.

10. A spacer for combining two reinforcement wire mesh cages in a concrete product inside a form with two spaced-apart inner surfaces and having a concrete cover defined by a distance between respective reinforcement wire mesh cages and their corresponding spaced-apart inner surfaces, the spacer comprising:

a continuous length of material comprising a first end portion, a second end portion, and an intermediate portion therebetween;

a first lock formed on the first end portion configured for attachment by torsion to a first reinforcement wire mesh cage of the two reinforcement wire mesh cages with a first spacer cover extending from the first lock away from the intermediate portion;

a second lock formed on the second end portion configured for attachment by torsion to a second reinforcement wire mesh of the two reinforcement wire mesh cages with a second spacer cover extending from the second lock away from the intermediate portion;

and wherein the first end portion and the second end portion of the continuous length are bent such that the two reinforcement wire mesh cages are held a fixed distance apart from each other, wherein a length of the first spacer cover is less than a distance from the corresponding reinforcement cage and the corresponding spaced apart inner surface of the form.

11. The spacer of claim 10, wherein the first lock further comprises: an inner cage, first wire lock and an inner cage, second wire lock formed on the first end portion configured for attachment by torsion to a wire of an inner cage; wherein the first spacer cover is positioned between the inner cage, first wire lock and the inner cage, second wire lock and is bent in a configuration to reduce an amount of material extending into the distance between the inner cage and one of the inner surfaces of the form;

and wherein the second lock further comprises: an outer cage, first wire lock and an outer cage, second wire lock formed in the second end portion each of which configured for attachment by torsion to a wire of an outer cage; and wherein the second spacer cover is positioned between the outer cage, first wire lock and the outer cage, second wire lock and is bent in a configuration to reduce an amount of material extending into the distance between the outer cage and the other inner surface of the form.

12. The spacer of claim 11, wherein the first bend and the second bend in the first end portion have a common axis transverse to an orientation of the intermediate portion of the continuous length of material to allow the inner cage, first wire lock and the inner cage, second wire lock to lock on opposite sides of a wire on the inner cage.

13. The spacer of claim 11, wherein the continuous length of material further comprises of a diameter, wherein the first spacer cover and the second spacer cover each have a dimension that is substantially equal to the diameter of the continuous length of material.

14. The spacer of claim 13, wherein second spacer cover is oriented on a plane perpendicular to the intermediate portion of the continuous length of material.

15. The spacer of claim 10, wherein the first spacer cover comprises a hump formed in the first end portion by a second bend in the first end portion toward a direction perpendicular to the intermediate portion of the continuous length of material so that the hump is oriented on the plane perpendicular to the intermediate portion of the continuous length of material.

16. The spacer of claim 15, wherein the hump is formed of a bend around an axis parallel to the intermediate portion of the spacer.

17. The spacer of claim 10, wherein a dimension of the first spacer cover is less than a dimension of the concrete cover.

18. The spacer of claim 10, wherein a dimension of the first spacer cover is substantially equal to a diameter of the continuous length of material.

19. The spacer of claim 10, wherein the first lock comprises a first bearing oriented in a first direction and a second bearing oriented in an opposite direction having a common axis extending between, and wherein the first end portion is bent between the first bearing and the second bearing to form the first spacer cover having a dimension less than a dimension of the concrete cover.

20. A spacer for securing an inner reinforcement cage relative to an outer reinforcement cage within a form for a concrete product, the spacer comprising:

a continuous length of material having a first end portion, a second end portion, and an intermediate portion therebetween;

a first wire lock and a second wire lock combined to the first end portion and formed by bends in the material, the first wire lock and second wire lock having centers aligned on a common axis transverse to the intermediate portion and configured to torsionally attach to the inner reinforcement cage;

a first spacer cover connecting the first wire lock and the second wire lock of the first end portion, wherein first spacer cover is oriented on a plane perpendicular to the intermediate portion of the continuous length of material;

a third wire lock and a fourth wire lock combined to the second end portion and formed by bends in the material, the third wire lock and fourth wire lock having centers aligned on a common axis transverse to the intermediate portion and configured to torsionally attach to the outer reinforcement cage;

a second spacer cover connecting the third wire lock and the fourth wire lock of the second end portion; and wherein each of the first spacer cover and the second spacer cover extends outward from the respective cage a distance less than a concrete cover distance defined between the respective cage and an adjacent inner surface of the form.

* * * * *